US005203727A

United States Patent [19]

Fukui

[11] Patent Number: 5,203,727

[45] Date of Patent: Apr. 20, 1993

[54] CONTROL APPARATUS FOR AN OUTBOARD MARINE ENGINE WITH IMPROVED CRUISING PERFORMANCE

[75] Inventor: Wataru Fukui, Himeji, Japan

[73] Assignee: Mitsubishi Denki Kabushiki Kaisha, Tokyo, Japan

[21] Appl. No.: 872,117

[22] Filed: Apr. 22, 1992

[30] Foreign Application Priority Data

Apr. 26, 1991 [JP] Japan ..... 3-96475

[51] Int. Cl.[5] ..... B63H 21/26

[52] U.S. Cl. ..... 440/1; 114/122; 114/360

[58] Field of Search ..... 440/1, 2; 114/122, 360

[56] References Cited

U.S. PATENT DOCUMENTS

| | | | |
|---|---|---|---|
| 4,647,928 | 3/1987 | Casey et al. | 114/122 |
| 4,767,363 | 8/1988 | Uchida et al. | 440/1 |
| 4,931,025 | 6/1990 | Torigai | 440/1 |
| 4,940,433 | 7/1990 | Raber | 440/1 |
| 5,118,315 | 6/1992 | Funami et al. | 440/1 |
| 5,142,473 | 8/1992 | Davis | 440/1 |

FOREIGN PATENT DOCUMENTS 30980 2/1990 Japan .

*Primary Examiner*—Sherman Basinger
*Assistant Examiner*—Thomas J. Brahan
*Attorney, Agent, or Firm*—Sughrue, Mion, Zinn, Macpeak and Seas

[57] ABSTRACT

A control apparatus for an outboard marine engine is able to improve cruising performance of a boat particularly during acceleration or travelling on a curved course. An attitude angle sensor senses a three-dimensional attitude of the outboard engine including a trim angle, a bank angle and a yaw or steering angle thereof, and generates corresponding attitude angle signals. A controller controls engine control parameters based on various signals indicative of engine operating conditions inclusive of the attitude angle signals in such a manner that the output power of the engine increases in accordance with an increasing trim angle, whereas it decreases in accordance with an increasing bank and/or yaw (steering) angle.

5 Claims, 4 Drawing Sheets

CONTROL APPARATUS FOR AN OUTBOARD MARINE ENGINE WITH IMPROVED CRUISING PERFORMANCE

BACKGROUND OF THE INVENTION

The present invention relates to a control apparatus for controlling the operation of an outboard marine engine. More particularly, it relates to an engine control apparatus which is able to adjust or modify engine control parameters in response to a three-dimensional attitude of an outboard engine, which is mounted on a boat, to prevent the boat from deviating from a predetermined cruising course for improved cruising performance.

FIG. 6 schematically illustrates a typical example of an outboard marine engine mounted on a boat. In this figure, the engine 1 in the form of an internal combustion engine for outboard use is disposed outside a boat hull 3 at the stern thereof and pivotally mounted to the boat hull 3 through a mounting bracket 1*a* so that it is pivotable around a vertical pivot axis (Z-axis) as well as an athwart pivot axis P1 (Y-axis) which extends horizontally athwart of the boat hull 3. Upon acceleration of the engine 1, it is caused under an acceleration force to pivot or incline around the athwart pivot axis P1 (Y-axis) at an attitude angle or angle of tilt $\Theta_1$ (i.e., so-called "trim angle") from a normal or vertical position (i.e., a reference or vertical line) which the engine 1 takes in a steady-state operation. The engine 1 is steered to turn around the vertical pivot axis (Z-axis) by an operator through an unillustrated steering and throttle arm lever. A propulsion screw 2 is disposed under water and operatively connected with the engine 1 so that it is thereby driven to rotate, generating a propulsion force.

FIG. 7 shows in block form the general construction of a conventional engine control apparatus for controlling the outboard engine 1 of FIG. 6. In this figure, a rotational speed sensor 4 mounted on a camshaft or crankshaft (not illustrated) of the engine 1 generates a crank angle signal R representative of a reference crankshaft position in synchronization with the rotation of the unillustrated crankshaft for sensing the rotational speed or the number of revolutions per minutes of the engine 1. A gear position sensor 5 senses the gear position of a transmission (not shown) of the engine 1 and generates a corresponding gear position signal G. A controller 6 receives output signals from various sensors indicative of various engine operating conditions such as the degree of throttle opening, the intake pressure in an intake manifold, etc., including the output signals R, G from the rotational speed sensor 4 and the gear position sensor 5, and generates a drive signal A for controlling various engine control parameters on the basis of these output signals. An actuator means 7 is operatively connected to receive the drive signal A from the controller 6 so that it is driven to operate by the controller 6 through the drive signal A. The actuator means 7 controls various driving and control elements or devices such as a fuel pump, an ignition coil, a throttle valve, a starter motor and the like associated with the engine 1.

Next, the operation of the above-described conventional engine control apparatus will be described in detail while referring to FIGS. 6 and 7. First, the controller 6 generates a drive signal A based on the output signals from the various sensors including the rotational speed signal R, the gear position signal G, the reference crank signal and the like representative of various engine operating conditions, for controlling the actuator means 7 (e.g., for controlling a fuel pump, an ignition coil, a throttle valve, etc.) as well as calculating and controlling operational timings thereof such as fuel supply or injection timing, ignition timing, etc. As a result of such calculations, the controller 6 generates an appropriate drive signal A so that the actuator 7 is thereby operated to properly control engine control parameters such as the flow rate of intake air sucked into the engine 1, the amount of fuel supplied to the engine 1, the ignition timing and the like, thus providing a desired number of revolutions per minute of the engine 1.

In this connection, since the engine load varies in accordance with a change in the three-dimensional attitude of the engine 1, control performed by the actuator means 7 on the engine control parameters through the drive signal A, which is calculated and generated by the controller 6 on the basis of various sensor signals without taking account of the engine load, becomes improper or unsuitable, so the boat often deviates from an intended cruising course such as during acceleration or turning motion thereof, thus reducing or impairing the cruising performance. In particular, in case of acceleration on a curved course, not only the trim angle $\theta_1$ but also other angles of inclination (bank and yaw angles) of the boat hull 3 with respect to three reference axes (i.e., the vertical Z-axis, the longitudinal X-axis extending longitudinally of the boat hull 3 and perpendicularly to the vertical Z-axis, and the athwart Y-axis extending athwart of the boat hull 3 and perpendicularly to the vertical Z-axis and the longitudinal X-axis) become greater, resulting in a greater deviation in the cruising course of the boat. Thus, the cruising performance of the boat is varied in accordance with the three-dimensional attitude of the outboard engine 1, so it is difficult for the conventional engine control apparatus to provide for intended good cruising performance desired by the operator at all times.

SUMMARY OF THE INVENTION

Accordingly, the present invention is aimed at overcoming the above-described problems encountered with the conventional marine engine control apparatus.

An object of the invention is to provide a novel and improved control apparatus for an outboard marine engine which is able to improve cruising performance of a boat during acceleration as well as turning movements thereof.

In order to achieve the above object, according to the present invention, there is provided a control apparatus for an outboard marine engine which is mounted on the hull of a boat for pivotal movements around an athwart pivot axis and a vertical pivot axis, the apparatus comprising: sensor means for sensing various operating conditions of the engine and generating corresponding output signals; an attitude angle sensor for sensing a three-dimensional attitude of the engine and generating corresponding attitude angle signals; a controller operatively connected to receive the output signals from the sensor means and the attitude angle sensor so that it generates a basic drive signal for controlling operating parameters of the engine based on the output signals from the sensor means, the controller including modification means for modifying the basic drive signal based on the attitude angle signals from the attitude angle sensor for optimal engine control; and actuator means operatively connected to receive the output drive signal from the controller so that it is thereby driven to optimally control the operation of the engine.

The attitude angle sensor senses a trim angle, a bank angle and a yaw angle of the outboard engine. The trim angle is defined as a tilt angle of the engine with respect to a vertical line around the athwart pivot axis. The bank angle is defined as an angle of side inclination of the engine with respect to a vertical line. The yaw angle is defined as a steering angle of the engine with respect to a longitudinal center line of the boat hull around a vertical line.

The controller modifies the basic drive signal such as to increase the output power of the engine in accordance with the increasing trim angle. This serves to increase the engine output power so as to meet an increasing engine load during acceleration of the boat.

The controller also modifies the basic drive signal in such a manner that the output power of the engine decreases in accordance with the increasing bank or yaw angle.

The above and other objects, features and advantages of the invention will become apparent from the ensuing detailed description of the invention taken in conjunction with the accompanying drawings.

DESCRIPTION OF THE PREFERRED EMBODIMENT

A preferred embodiment of the invention will now be described in detail with reference to the accompanying drawings.

Figure 1:
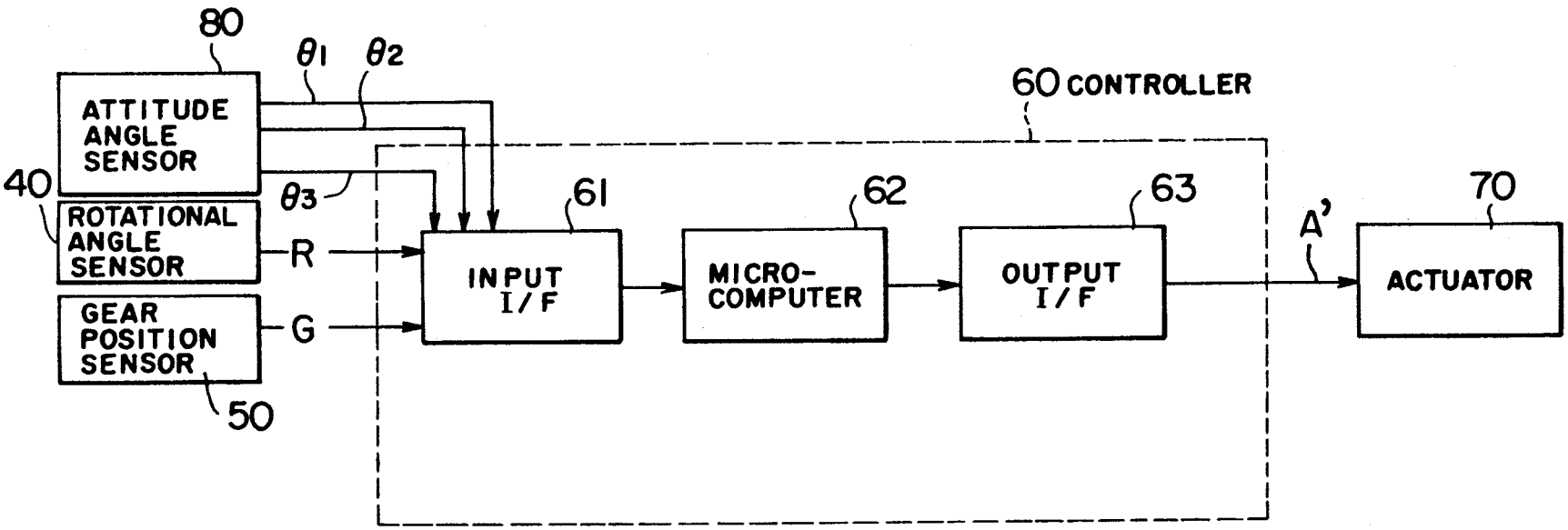
FIG. 1 is a block diagram of an engine control apparatus for an outboard marine engine in accordance with the present invention.
Figure 6:
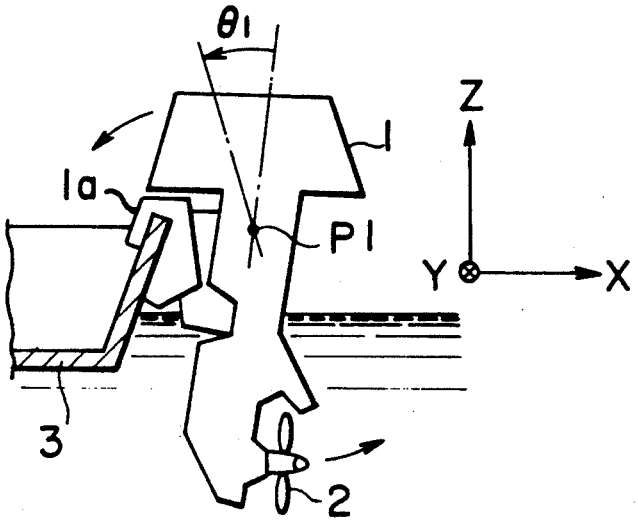
FIG. 6 is a schematic illustration showing the general construction of the outboard marine engine.

FIG. 1 shows in block form an engine control apparatus for controlling the operation of an outboard marine engine constructed in accordance with the principles of the present invention. In this figure, the apparatus illustrated includes, in addition to a rotational speed sensor 40, a gear position sensor 50 and an actuator means 70 all of which are similar to the corresponding elements 4, 5 and 7, respectively, of FIG. 7, an attitude angle sensor 80 for sensing the three-dimensional attitude of an outboard marine engine 1 (see FIG. 6) and generating corresponding attitude angle signals $\Theta_1$, $\Theta_2$, $\Theta_3$, and a controller 60 for controlling the actuator means 70 on the basis of the output signals from the sensors 40, 50 and 80 as well as other signals from unillustrated sensors representative of various engine operating conditions.

The controller 60 comprises an input interface 61 to which various signals inclusive of a rotational speed signal R from the rotational speed sensor 40, a gear position signal G from the gear position sensor 50 and attitude signals $\Theta_1$, $\Theta_2$, $\Theta_3$ from the attitude sensor 80 as well as other signals representative of various engine operating conditions are input, a microcomputer 62 for effecting various computations and making determinations on the basis of various input signals supplied to the input interface 61 and generating a drive signal A' for controlling and driving the actuator means 70, and an output interface 63 for outputting the drive signal A' generated by the microcomputer 62 to the actuator means 70.

Figure 2:
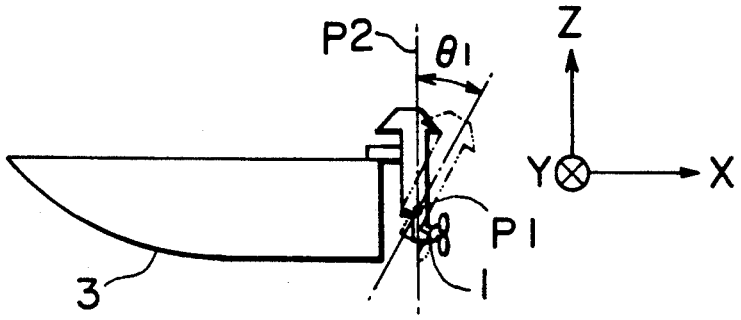
FIG. 2 is an explanatory view showing a trim angle $\Theta_1$ of an outboard marine engine as shown in FIG. 6.
Figure 3:
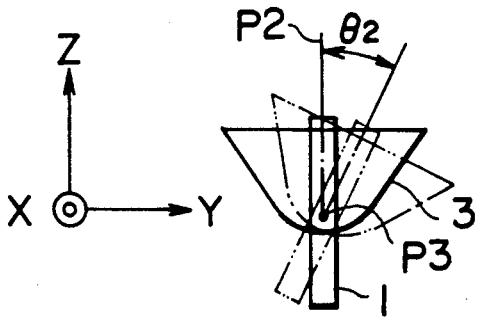
FIG. 3 is an explanatory view showing a bank angle $\Theta_2$ of a boat hull or the engine of FIG. 6.
Figure 4:
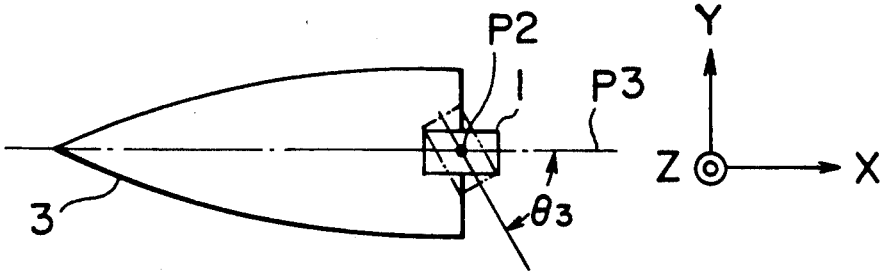
FIG. 4 is an explanatory view showing a yaw or steering angle $\Theta_3$ of the engine of FIG. 6.

The attitude angle sensor 80 comprises, for example, a vector-type angular velocity sensor such as a gas rate sensor which senses the three-dimensional attitude of the outboard marine engine 1, i.e., a trim angle $\Theta_1$, a bank angle $\Theta_2$ and a yaw or steering angle $\Theta_3$ of a boat on which the engine control apparatus of the invention is mounted, and generates corresponding attitude angle signals comprising a trim-angle signal, a bank-angle signal and a yaw-angle signal to the input interface 61 of the controller 60. Specifically, the trim angle $\Theta_1$ is defined as an angle of tilt of the engine 1 with respect to a vertical reference line P2 (Z-axis) about a first or athwart pivot axis P1 (Y-axis) which extends horizontally athwart of the boat hull 3, as clearly shown in FIG. 2. The bank angle $\Theta_2$ is defined as an angle of side inclination of the engine 1 or the boat hull 3 with respect to the vertical reference line P2 (Z-axis) around a second or longitudinal pivot axis P3 (X-axis) which extends horizontally and longitudinally of the boat hull 3, as clearly shown in FIG. 3. The yaw angle $\Theta_3$ is defined as an angle of steering of the engine 1 around a vertical pivot axis or the vertical reference line P2 (Z-axis), as clearly shown in FIG. 4. The trim angle $\Theta_1$ and the yaw angle $\Theta_3$ are varied by a steering operation of an operator, whereas the bank angle $\Theta_2$ may vary irrespective of the operator's will or steering operation. In addition, instead of using the vector-type angular velocity sensor, the trim angle $\Theta_1$ and the yaw or steering angle $\Theta_3$ can be directly sensed by measuring rotational or steering angles of the engine 1 around the athwart and vertical pivot axes P1, P2, respectively, caused by the operator.

Figure 7:
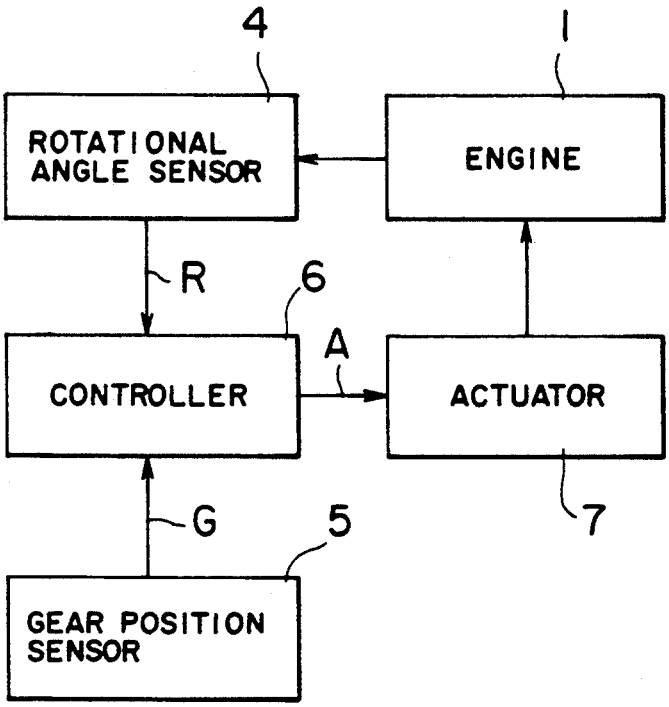
FIG. 7 is a block diagram of a conventional engine control apparatus for an outboard marine engine.

The microcomputer 62 in the controller 60 computes control quantities for engine control parameters based on various engine operating conditions which are sensed by and input thereto from various sensors via the input interface 61, and generates a corresponding basic drive signal A for driving and controlling the actuator means 70, as described with reference to the conventional engine control apparatus of FIG. 7.

The microcomputer 62 includes a correcting or modifying means for correcting or modifying the thus computed basic control quantities for engine control parameters in dependence upon the attitude angle signals indicative of the trim angle $\Theta_1$, the bank angle $\Theta_2$ and the yaw or steering angle $\Theta_3$ supplied from the attitude angle sensor 80 to the input interface 61 of the controller 60, as will be described later in detail.

Figure 5:
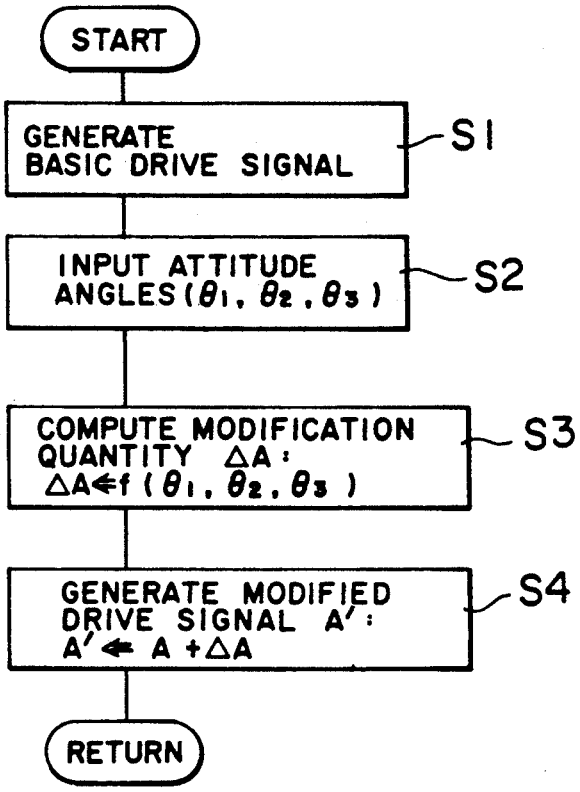
FIG. 5 is a flow chart showing the operational process of the apparatus of FIG. 1.

Next, the operation of the above embodiment will be described in detail while referring to the flow chart of FIG. 5 as well as FIGS. 2 through 4 and FIG. 6. As shown in FIG. 5, first in Step S1, the microcomputer 62 computes the rotational speed or the number of revolutions per minute of the engine 1 based on the output signal R from the rotational speed sensor 40, and it determines the current gear position of an unillustrated transmission of the engine 1 based on the gear position signal G from the gear position sensor 50. On the basis of the rotational speed and the current gear position of the engine 1 as well as other engine operating conditions as sensed by unillustrated various sensors, the microcomputer 62 computers optimal control quantities for engine control parameters such as a degree of opening of a throttle valve, an amount of fuel to be supplied to the engine 1, the ignition timing, etc., and generates a corresponding basic drive signal A for controlling and driving the actuator means 70 to this end.

In Step S2, the attitude angle signals indicative of the trim angle $\Theta_1$, the bank angle $\Theta_2$ and the yaw or steering angle $\Theta_3$ of the engine 1, as sensed by the attitude angle sensor 80, are input therefrom to the microcomputer 62 via the input interface 61.

In Step S3, on the basis of these attitude angle signals, the microcomputer 62 computes a correction or modification quantity $\Delta A$ for correcting or modifying the basic engine control parameters as follows.

$$\Delta A = f(\Theta_1, \Theta_2, \Theta_3)$$

Then in Step S4, based on the correction or modification quantity $\Delta A$ thus computed, the microcomputer 62 modifies the basic drive signal A in the following manner to provide a corrected or modified drive signal A' which is supplied via the output interface 63 to the actuator means 70.

$$A' = A + \Delta A$$

In this manner, the actuator means 70 is properly controlled or driven by the modified drive signal A' from the microcomputer 62 to thereby control the engine control parameters in an optimal manner. Specifically, for example, if the trim angle $\Theta_1$ of the engine 1 increases such as during rapid acceleration of the engine 1 and hence of the boat hull 3, the correction or modification quantity $\Delta A$ is increased to augment the output power of the engine 1 so as to meet the increasing engine load. On the other hand, however, if the bank angle $\Theta_2$ or the steering angle $\Theta_3$ is increased such as when the boat is steered to turn around a curved course, the correction or modification quantity $\Delta A$ is decreased to reduce the engine output power so as to prevent overturn of the boat due to an otherwise increasing centrifugal force acting thereon.

Moreover, the control of increasing or decreasing the engine output power can be made by means of the drive signal A' supplied to the actuator means 70 in a variety of ways. For example, on the basis of the drive signal A', the actuator 70 adjusts to increase or decrease the amount of fuel supplied from an unillustrated fuel pump to the engine 1, or it adjusts to properly advance or delay the ignition timing of the engine 1, or it increases or decreases the throttle opening (i.e., the degree of opening of an unillustrated throttle valve).

In this manner, the original or basic drive signal A is modified on the basis of the attitude angles $\Theta_1$, $\Theta_2$, $\Theta_3$ of the engine 1 to provide the modified drive signal A' whereby the operation of the actuator means 70 can be properly corrected or modified to allow the engine 1 to exhibit its maximum cruising performance other than during turning motion of the boat, thus ensuring excellent acceleration performance of the boat in exact response to the operator' will or steering operation while avoiding overturn of the boat during turning motion along a curved course.

What is claimed is:

1. A control apparatus for an outboard marine engine in which the outboard engine is mounted on the hull of a boat for pivotal movements around an athwart pivot axis and a vertical pivot axis, said apparatus comprising:

sensor means for sensing various operating conditions of the engine and generating corresponding output signals;

an attitude angle sensor for sensing a three-dimensional attitude of the engine and generating corresponding attitude angle signals;

a controller operatively connected to receive the output signals from said sensor means and said attitude angle sensor for continuously generating a basic drive signal for controlling operating parameters of the engine based on the output signals received directly from said sensor means, said controller including modification means for continuously modifying the basic drive signal based on the attitude angle signals from said attitude angle sensor for optimal engine control; and actuator means operatively connected to receive the modified output drive signal from said controller and for controlling the engine in accordance therewith to optimally control the operation of the engine while at the same time preventing an overturn of the boat due to centrifugal force.

2. A control apparatus according to claim 1, wherein said attitude angle sensor senses a trim angle, a bank angle and a yaw angle of the outboard engine, the trim angle being defined as a tilt angle of the engine with respect to a vertical line around the athwart pivot axis, the bank angle being defined as an angle of side inclination of the engine with respect to a vertical line, and the yaw angle being defined as a steering angle of the engine with respect to a longitudinal center line of the boat hull around a vertical line.

3. A control apparatus according to claim 2, wherein said controller modifies the basic drive signal in such a manner that the output power of the engine increases in accordance with the increasing trim angle.

4. A control apparatus according to claim 2, wherein said controller modifies the basic drive signal in such a manner that the output power of the engine decreases in accordance with the increasing bank angle.

5. A control apparatus according to claim 2, wherein said controller modifies the basic drive signal in such a manner that the output power of the engine decreases in accordance with increasing yaw angle.

* * * * *